US006345633B1

(12) United States Patent
Tartakovsky et al.

(10) Patent No.: US 6,345,633 B1
(45) **Date of Patent: *Feb. 12, 2002**

(54) AUTOMATIC DISHWASHING COMPOSITIONS CONTAINING WATER SOLUBLE CATIONIC SURFACTANTS

(75) Inventors: Alla Tartakovsky, West Orange; Joseph Oreste Carnali, Pompton Plains, both of NJ (US)

(73) Assignee: Unilever Home & Personal Care USA division of Conopco, Inc., Greenwich, CT (US)

( * ) Notice: Subject to any disclaimer, the term of this patent is extended or adjusted under 35 U.S.C. 154(b) by 0 days.

This patent is subject to a terminal disclaimer.

(21) Appl. No.: 09/704,486

(22) Filed: Nov. 2, 2000

Related U.S. Application Data

(60) Provisional application No. 60/164,455, filed on Nov. 10, 1999.

(51) Int. Cl.[7] ..... H08B 3/08; C11D 1/62; C11D 3/386; C11D 3/395; C11D 3/06

(52) U.S. Cl. ..... 134/25.2; 510/220; 510/224; 510/228; 510/504; 510/226; 510/446; 510/447

(58) Field of Search ..... 510/220, 222, 510/224, 228, 237, 504, 226, 446, 447; 134/25.2

(56) References Cited

U.S. PATENT DOCUMENTS

| | | | | | |
|---|---|---|---|---|---|
| 5,298,289 | A | | 3/1994 | Lindert et al. | 427/388.4 |
| 5,880,088 | A | | 3/1999 | Lentsch et al. | 510/514 |
| 5,880,089 | A | | 3/1999 | Lentsch et al. | 510/514 |
| 5,958,858 | A | * | 9/1999 | Bettiol et al. | 510/351 |
| 6,015,781 | A | * | 1/2000 | Vinson et al. | 510/302 |
| 6,133,222 | A | * | 10/2000 | Vinson et al. | 510/428 |
| 6,136,769 | A | * | 10/2000 | Asano et al. | 510/329 |
| 6,153,577 | A | * | 11/2000 | Cripe et al. | 510/356 |

FOREIGN PATENT DOCUMENTS

| | | |
|---|---|---|
| EP | 0 318 279 A | 5/1989 |
| EP | 0 432 836 | 6/1991 |
| EP | 1 028 161 A | 8/2000 |
| WO | 93/04152 | 3/1993 |
| WO | 97/43388 | 11/1997 |
| WO | 99/05248 | 2/1999 |

OTHER PUBLICATIONS

International Search Report dated Mar. 14, 2001.

* cited by examiner

*Primary Examiner*—Gregory Delcotto

(57) ABSTRACT

Automatic dishwashing compositions containing water soluble cationic surfactants are shown to reduce spotting and filming on plastic articles while reducing damage to the plastic articles.

2 Claims, No Drawings

AUTOMATIC DISHWASHING COMPOSITIONS CONTAINING WATER SOLUBLE CATIONIC SURFACTANTS

This application claims the benefit of U.S. Provisional Application No. 60/164,455, filed Nov. 10, 1999.

FIELD OF THE DISCLOSURE

The present disclosure is in the field of machine dishwashing. More specifically, the disclosure relates to automatic dishwashing detergents in granular, liquid, gel, solid and tablet form which contain a cationic, water soluble surfactant for the purpose of improving the final appearance of washed plastic articles.

BACKGROUND

Machine dishwashing detergents constitute a generally recognized distinct class of detergent compositions. In general, machine dishwashing detergents are mixtures of ingredients whose purpose, in combination, is to breakdown and remove food soils; to inhibit foaming caused by certain food soils; to promote the wetting of wash articles in order to minimize or eliminate visually observable spotting and filming; to remove stains such as might be caused by beverages such as coffee and tea or by vegetable soils such as carotenoid soils; to prevent a buildup of soil films on wash ware surfaces; and to reduce or eliminate tarnishing of flatware. It is particularly critical to a consumer's perception of how well a machine dishwashing detergent performs that residual spotting and filming on wash articles be controlled or prevented entirely.

In conventional institutional and domestic dishwashing, a strongly alkaline solution is produced and used to wash dishes, glasses, and other cooking and eating utensils. One or more rinse cycles then follow this main wash cycle, in which any removed soil as well as the remaining detergent are expelled from the washing machine. A subsequent drying cycle may optionally be employed. Ordinary tap water can be used in preparing the strongly alkaline cleaning and rinse solutions, however, in European applications, this tap water is often treated (softened) to remove hardness ions such as calcium and magnesium with the result that hard water residues on washware are reduced. Nevertheless, spotting and filming from soil residues and precipitates can remain a problem, especially if the ion exchange unit serving the dishwashing machine is operating inefficiently. This problem can be minimized with a machine dishwashing composition containing a relatively high level of polyphosphate which acts to sequester hardness ions and to aid in soil removal and stabilization. In addition, these detergents usually contain a chlorine bleaching system for stain removal and for an added cleaning boost via oxidation of proteinaceous soils, thus helping to eliminate spotting on glassware.

Although the cleaning performance of these conventional detergent compositions is satisfactory, high phosphate levels, chlorine bleach, and high alkalinity have potential environmental and consumer drawbacks. As a result, an alternative technology was developed to deliver less alkaline products. Similarly, nonphosphated builders are substituted to further improve the environmental profile of the composition. As a consequence of the reduced cleaning efficiency of the modified composition, various detersive enzymes including amylolytic and proteolytic enzymes are included in the detergent composition in order to boost removal of starchy and proteinaceous soils, respectively. Because these enzymes are not compatible with chlorine bleach systems, an oxygen bleaching system can be substituted which can result in a reduction in bleach performance. Often, enzymatic compositions based on oxygen bleaches are formulated with a phosphate builder, in markets where local legislation will allow, to assure good overall performance. An unfortunate weakness in the performance of this alternative technology, both in formulations which are phosphated (i.e., containing inorganic phosphate builder salts) and those which are nonphosphated, is that they can often leave wash ware spotted or with a visible coating of film which is aesthetically unacceptable in both domestic and institutional environments. A consumers perception of residual spotting and filming can give rise to an unfavorable rating of an otherwise premium performing machine dishwashing product.

In order to substantially prevent the formation of spotting and filming, dedicated additives are included into the wash and/or rinse cycles of the washing machine. Preferably, dedicated rinse aids have commonly been added to the water used for performing the rinsing step(s). The precise mechanism through which rinse aids work is not established. One theory holds that a surfactant in the rinse aid is adsorbed on the washware surface at temperatures at or above its cloud point, and thereby reduces the solid/liquid interfacial energy and contact angle. This reduction leads to the formation of a continuous sheet which drains evenly from the surface and minimizes the formation of spots and film. The delivery of a similar sheeting action from the main wash has thus far proven very difficult.

Commonly available rinse aids have primarily focused on reducing spotting and filming on surfaces such as glass, ceramics, china, and metal. However, plastic washware is becoming more commonly used, especially in the institutional market. A special problem with plasticware is the possible chemical attack and crazing of the ware in the presence of certain components of the rinse aid or of the main wash detergent formulation. Many effective rinse aid components, such as fatty alcohol or alkyl phenol-based nonionic surfactants, also strongly attack plastic articles. The terms plasticware and plastic articles are defined herein to include articles composed of polycarbonate, melamine, polypropylene, polyester resin, polysulfone, and the like.

It is an object of the present disclosure to provide compositions, suitable for use in machine dishwashing methods, having the ability to provide excellent sheeting properties on plastic wash articles and so producing said articles which are aesthetically acceptable and free from spots and film. Further, such an acceptable plasticware appearance is achieved without endangering said articles due to attacking or crazing. Surprisingly, it has been discovered that a preferred embodiment of the present disclosure can deliver this appearance benefit from the main wash while at the same time maintaining an overall good cleaning performance towards soiled articles.

U.S. Pat. No. 5,298,289 describes the treatment and after-treatment of surfaces, especially metals, with derivatives of polyphenol compounds. These compositions are also said to be useful in treating plastic and painted surfaces to improve rinsability without water breaks. The surfactants employed are a combination of previously known anionic and nonionic surfactants.

European Patent Publication 0,432,836 describes the use of alkyl polyglycoside surfactants in rinse aid compositions on polycarbonate.

U.S. Pat. Nos. 5,880,088 and 5,880,089 discuss a rinse aid composition consisting, in part, of a polyalkylene oxide modified poly dimethylsiloxane or polybetaine modified polysiloxane surfactant, in combination with a fluorinated hydrocarbon surfactant. This composition is claimed to be compatible with plasticware.

The prior art is silent on the use of cationic surfactants in machine dishwashing formulations for the improvement of the final appearance of plastic washware.

SUMMARY

It has now been discovered that a class of water soluble, cationic surfactants provide an unexpected and enhanced appearance benefit to plastic articles when incorporated in the dishwashing process, as evidenced, in part, by a reduction in the formation of spots and film on the washed articles. For a preferred class of water soluble, cationic surfactants, it has surprisingly also been discovered that this enhanced benefit is not accompanied by any compromise in the article durability due to chemically caused attack or crazing.

The essential surfactants may be incorporated at any point in the dishwashing process and have been found to improve the appearance of washed plastic articles. Thus, the surfactants may be incorporated into typical detergent or rinse aid formulations and in any desired form such as tablets, powders, granulates, pastes, liquids, and gels. Additionally, is has surprisingly been found that the final appearance benefit can be realized via incorporation in the main wash.

Preferably, the machine dishwashing detergents have:

a) an effective amount of a defined cationic, water soluble surfactant; and b) an effective amount of a builder.

"Water soluble" surfactants are, unless otherwise noted, herein defined to include solutes which, because of their molecular weight or chemical composition, are soluble to at least the extent of 0.01% by weight in distilled water at 25° C. "Cationic" surfactants herein include solutes in which at least one of the groups making up the chemical structure contains a cationic charge over a portion of the wash pH range of pH 6 to pH 11. Surfactants, as defined in "Principles of Colloid and Surface Chemistry", by P. C. Hiemenz and R. Rajagopalan, are a particular class of solutes which show a dramatic effect on the surface tension of the solvent. Water soluble cationic surfactants are thus distinguished from water soluble cationic polymers in that the former are surface active and have a molecular weight which is typically about 1000 or below while the latter have a molecular weight well in excess of 1000 and do not dramatically affect the surface tension of water.

It is expected that the wash pH at which the preferred detergents would be employed would either naturally fall within the pH range 6–11 or, optionally, would be buffered in that range.

DETAILED DESCRIPTION

The compositions preferably contain a water soluble, cationic surfactant and a phosphate or nonphosphate builder.

Phosphate Builder

When the compositions utilize a water-soluble phosphate builder, this builder preferably present at a level of from 1 to 90% by weight, preferably from 10 to 80% by weight, most preferably from 20 to 70% by weight of the composition. Specific examples of water-soluble phosphate builders are the alkali metal, ammonium and alkanol ammonium tripolyphosphates, sodium, potassium and ammonium pyrophosphate, sodium and potassium orthophosphate, sodium polymeta/phosphate in which the degree of polymerization ranges from about 6 to 21, and salts of phytic acid. Sodium or potassium tripolyphosphate is most preferred.

Nonphosphate Builder

When the compositions utilize a water-soluble nonphosphate builder, this builder is preferably present at a level of from 1 to 90% by weight, preferably from 10 to 80% by weight, most preferably from 20 to 70% by weight of the composition. Suitable examples of non-phosphorus-containing inorganic builders include water-soluble alkali metal carbonates, bicarbonates, sesquicarbonates, borates, silicates, metasilicates, and crystalline and amorphous aluminosilicates. Specific examples include sodium carbonate (with or without calcite seeds), potassium carbonate, sodium and potassium bicarbonates, silicates including layered silicates and zeolites. A particularly preferred layered silicate is SKS-6 (available from Hoechst) although others such as SKS-5, SKS-7 and SKS-11 (also available from Hoechst), may also be used. U.S. Pat. No. 4,605,509 provides suitable examples of preferred aluminosilicates. Many useful aluminosilicates are commercially available and these may be crystalline or amorphous in nature. Preferred aluminosilicates include Zeolite A, Zeolite B, Zeolite MAP and Zeolite X. The particle size for these zeolitic materials should be in the preferred range of 0.1–10 microns diameter while individual particles may be even smaller than 0.1 microns so that a large surface area, which promotes exchange kinetics, is exposed. This large surface area also facilitates the role of zeolites in their role as surfactant carriers. This advantage of modifying zeolite and other builder morphology to most efficiently also serve as surfactant carriers can always be suitably exploited by those skilled in the art.

Organic detergent builders can also be used. These are typically, but are not restricted to, polycarboxylate materials. Polycarboxylate builders are those which have at least two carboxylate groups present in the compound and may be used either in the acidic form or as the neutralized soluble salt form. The alkali metal salts, such as lithium, sodium, and potassium or the ammonium or alkanol ammonium salts are the preferred forms. Within the class of polycarboxylate builders are various sub-classes of materials.

Citrate derived builders, preferably their soluble alkali metal salts, most preferably the sodium salt, are especially important with respect to machine dishwashing formulations. This importance is derived from their biodegradability and from their agricultural based availability. Malonates and dipicolinates are another subclass of builder materials.

Ether polycarboxylates are another important example of polycarboxylate builders. This class can be exemplified by the particularly preferred oxydisuccinate which has been revealed by Lamberti et. al. in U.S. Pat. No. 3,635,830 and by Berg et. al. in U.S. Pat. No. 3,128,287. Other examples of ether polycarboxylates include the "TMS/TTDS" builders disclosed in U.S. Pat. No. 4,663,071. Cyclic ether polycarboxylates as disclosed in U.S. Pat. Nos. 4,158,635; 4,120,874; 4,102,903; 3,923,679; and 3,835,163 are also builders which can be employed. Other classes of materials that fall into the category of ether polycarboxylates builders are the tartrate monoacetates, tartrate diacetates, oxydiacetates, tartrate monosuccinates, tartrate disuccinates and carboxymethyloxy succinates. 3,3-Dicarboxy-4-oxa-1,6-hexanedionates and the related compounds which are revealed in U.S. Pat. No. 4,566,984, mellitic acid and 3,5-dicarboxybenzoic acid are also suitable builders.

Another sub class of polycarboxylates are those derived by substitution onto an ammonia core or the aminopolycarboxylates. Examples within this class, but not restricted to, are ethylenediamine tetraacetates, methyl glycinediacetates and the particularly preferred nitrilotriacetates.

Builders derived from succinic acid are also useful in machine dishwashing formulations. Examples of these include the $C_5$–$C_{20}$ alkyl and alkenyl succinates. Particularly preferred examples of these are lauryl succinates (disclosed in European Patent Application 86200690) and 2-dodecenylsuccinate. Other non-limiting examples include myristyl-succinate, palmitylsuccinate and 2-pentadecenylsuccinate.

Polymeric polycarboxylates also serve as valuable building materials in machine dishwashing formulations. These include polycarboxylates such as polyacrylates, polymaleates, polyacetates, polyhydroxyacrylates, polyacrylatelpolymaleate and polyacrylate/ polymethacrylate copolymers, acrylate/maleate/vinyl alcohol terpolymers, and polyacetal carboxylates, and polyaspartates and mixtures thereof. Such carboxylates are described in U.S. Pat. Nos. 4,144,226, 4,146,495 and 4,686,062. Other examples of polymeric builders include oxidized starches and oxidized heteropolymeric polysaccharides. The acrylate/maleate copolymers and acrylate/maleate/vinyl alcohol terpolymers are especially preferred.

Simple fatty acid monocarboxylates, either in acid or salt form of the $C_{12}$–$C_{20}$ fatty acids, may be used either in conjunction with the other mentioned builders, esp. the succinates or tartarates, or alone to provide more building capacity. While such builders can act as antifoaming/ defoaming systems, which is a desirable attribute in machine dishwashing formulations, they tend, under hard water conditions, to deposit residues on surfaces and hence are not preferred.

Organic builders that do not rely on the carboxylate functionality also exist and examples of these include the fatty acid sulfonates, phytates, phosphonates (see for e.g. U.S. Pat. Nos. 3,159,581; 3,213,030; 3,422,021, 3,400,148 and 3,422,137), alkanehydroxyphosphonates (e.g. Ethane-1-hydroxy-1,1-diphosphonate) and polyhydroxysulfonates (e.g. 3,5-dihydroxy-2,4,6-trisulfonic acid phenol), Alkali metal citrates, nitrilotriacetates, oxydisuccinates, polyphosphonates organic builders. The citrates and oxydisuccinates can also be used in combinations with BRITESIL and/or layered silicates.

The foregoing detergent builders are meant to illustrate but not limit the types of builders that can be employed.

Water Soluble Cationic Surfactant

"Water soluble" surfactants are, unless otherwise noted, herein defined to include solutes which, because of their molecular weight or chemical composition, are soluble to at least the extent of 0.01% by weight in distilled water at 25° C. "Cationic" surfactants herein comprise solutes in which at least one of the groups making up the chemical structure contains a cationic charge over a portion of the wash pH range of pH 6 to pH 11. "Surfactants", as defined in "Principles of Colloid and Surface Chemistry", by P. C. Hiemenz and R. Rajagopalan, are a particular class of solutes which show a dramatic effect on the surface tension of the solvent. Water soluble cationic surfactants are thus distinguished from water soluble cationic polymers in that the former are surface active and have a molecular weight which is typically about 1000 or below while the latter have a molecular weight well in excess of 1000 and do not dramatically affect the surface tension of water.

It is expected that the wash pH at which the preferred detergents would be employed would either naturally fall within the range 6–11 or, optionally, would be buffered in that range.

Specifically, surfactants useful in this invention may be represented structurally as organic quaternary ammonium compounds as in formula I:

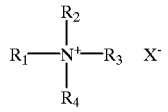

(I)

wherein $R_1$ can generally be a straight, branched, or cyclic; saturated or unsaturated; substituted or unsubstituted group containing from about 6 to about 20 carbon atoms. $R_2$, $R_3$, and $R_4$ can generally each independently be a straight, branched, or cyclic; saturated or unsaturated; substituted or unsubstituted group containing from about 1 to about 10 carbon atoms or a poly oxyalkene condensate of about 1 to about 25 oxyalkene units. It is understood that two of $R_2$, $R_3$, and $R_4$ may be taken together with the nitrogen group to which they are attached to form an aliphatic or aromatic heterocycle as in derivatives of pyrrole, pyrrolidone, or piperidine. Similarly, it is understood that $R_2$, $R_3$, and $R_4$ may be taken together with the nitrogen group to which they are attached to form an aromatic heterocycle as in derivatives of pyridine. X is an anion chosen from chloride, iodide, bromide, methyl sulfate, ethyl sulfate, sulfate and the like.

In a preferred embodiment of the present invention, $R_1$ is a linear, saturated group containing from about 6 to about 20 carbon atoms, $R_2$ is a linear, saturated group containing from about 1 to about 2 carbon atoms, $R_3$ is a linear, saturated group containing from about 1 to about 2 carbon atoms or is a poly oxyethene condensate given by the general formula:

$$—(CH_2CH_2O)_mH \quad (II)$$

and $R_4$ is a linear, saturated group containing from about 1 to about 2 carbon atoms or is a poly oxyethene condensate given by the general formula:

$$—(CH_2CH_2O)_nH \quad (III)$$

with the understanding that the integers m and n are such that their sum is from about 3 to about 40 and with the stipulation that one of $R_3$ or $R_4$ must be a poly oxyethene condensate. X is an anion chosen from chloride, iodide, bromide, methyl sulfate, ethyl sulfate, sulfate and the like.

Examples of preferred cationic surfactants include, but are not limited to, methyl bis-(polyethoxy ethanol) coco ammonium chloride, methyl bis-(2-hydroxyethyl) coco ammonium chloride, and methyl bis-(polyethoxy ethanol) tallow ammonium chloride. These materials are provided by the witco Corporation under the trade names Rewoquat CPEM, Variquat 638, and as the experimental compound DPSC 287-21, respectively.

In a particularly preferred embodiment, $R_1$ is a linear, predominately saturated group containing primarily from about 8 to about 18 carbon atoms, as would be found in derivatives from tallow or coconut oil, $R_2$ is a methyl or an ethyl radical, $R_3$ is a methyl or an ethyl radical or is a poly oxyethene condensate given by the general formula:

$$—(CH_2CH_2O)_mH \quad (II)$$

and $R_4$ is a methyl or an ethyl radical or is a poly oxyethene condensate given by the general formula:

$$—(CH_2CH_2O)_nH \quad (III)$$

with the understanding that the integers m and are such that their sum is from about 10 to about 20 and with the stipulation that one of $R_3$ or $R_4$ must be a poly oxyethene condensate. It has been found that if the sum of m and n are less than about 10, the disclosed benefits decrease. X is an anion chosen from chloride, iodide, bromide, methyl sulfate, ethyl sulfate, sulfate and the like.

Examples of cationic surfactants comprising the particularly preferred embodiment include, but are not limited to, methyl bis-(polyethoxy ethanol) coco ammonium chloride and ethyl bis-(polyethoxy ethanol) tallow ammonium chloride. These materials are provided by the Witco Corporation under the trade names Variquat K-1215 and Adogen 66, respectively.

An effective amount of said cationic-surfactant is 0.1 to 20%, preferably 0.5 to 10%, most preferably 1 to 5%, all by weight, of the total detergent formulation.

Optional Ingredients

In addition to the essential ingredients described herein above, the presently disclosed compositions may be formulated as detergent compositions having conventional ingredients, preferably selected from enzymes, buffering systems, oxygen bleaching systems, surfactants, heavy metal ion sequestrants, antiscalants, corrosion inhibitors, and antifoams.

Enzymes

Enzymes capable of facilitating the removal of soils from a substrate—detersive enzymes—may also be present in a combined amount of up to about 10% by weight of active enzyme. Such enzymes include proteases, amylases, lipases, esterases, cellulases, pectinases, lactases and peroxidases as conventionally incorporated into detergent compositions. While compositions with single enzymes may be used it is highly preferred for machine dishwashing formulations to use combinations of two or more enzymes. Furthermore, since most formulations contain oxidative bleaches, enzymes, especially amylases and proteases, which have been engineered to have improved bleach stability are highly preferred. Such engineering of enzymes is known (see for e.g. J. Biol. Chem. 260, 11, 1985, 6518–6521).

While enzymes may be derived from yeast, fungal, bacterial, animal or vegetable origin, the choice of which one to use is really determined by finding the most suitable intersection of the optima with respect to activity v/s pH, and stability to heat, bleach and other functional ingredients (e.g. surfactants, builders etc.) present in the formulation. It is known that with respect to such selection criteria bacterial proteases and amylases and fungal cellulases are preferred.

Examples of proteases include Alcalase®, Savinase® and Esperase® from Novo Industries A/S; Purafect OxP®, ex. Genencor; and Maxatase® from International BioSynthetics Inc. Other examples of proteases include Protease A and Protease B as disclosed in European Patent Application 130,756 published Jan. 9 1985 and the proteases disclosed in U.S. Pat. Nos. 5,677,272 and 5,679,630. The proteases Alcalase and Savinase are preferred enzymes.

Examples of amylases include Termamyl® and Duramyl® from Novo Industries A/S; Purafect OxAm®, from Genencor Int. and Rapidase® from International BioSynthetics Inc and amylases such as those described in British Patent Specification No. 1,296,839. The amylases Termamyl and Duramyl are preferred. Amylase variants produced by site directed mutagenesis of precursor amylases which are currently available and which have increased stability, relative to current references such as Termamyl in one or more properties such as temperature stability, especially at wash temperatures of 45–75° C.; alkaline stability, especially at wash pH values of 8.5–11 and oxidative stability, especially in the presence of environments containing peracids are especially preferred. Examples of such stability enhanced amylases are disclosed in WO/94/02597 wherein variants of precursor enzymes such as Termamyl® have been disclosed.

The use of lipase enzymes in ADD formulations is known in the art as disclosed in U.S. Pat. No. 5,719,112. Commercial examples of lipases include Lipolase®—derived from Humicola lanuginosa—from Novo Industries A/S, Amano-CES from Toyo Jozo Co., Tagata, Japan, and lipases derived from Chromobacter viscosum available from U.S. Biochemical Corp., U.S.A and Diosynth Co., The Netherlands. Lipolase® and variants of lipases from Humicola lanuginosa as disclosed in WO92/05249 are preferred.

Cellulases such as those disclosed in U.S. Pat. No. 4,435,307, GB-A-2,075,028 and GB-A-2,095,275 may also be included in the instant invention. The commercially available Carezyme® from Novo Industries A/S is especially preferred.

The relatively fragile nature of enzymes necessitates the use of techniques to stabilize them from other reactive species present in the composition or under in-use conditions. Such techniques have been revealed in U.S. Pat. Nos. 3,600,319; 3,519,570 and in Eur. Pat. Application No. 0 199 405. Means for incorporating enzymic materials into detergent compositions are disclosed in U.S. Pat. No. 3,553,139.

Buffering System

The buffering system may be present in order to deliver a pH of about 6 to about 11 in the wash water. A controlled pH profile during the entire wash cycle allows for maximum efficiency to be obtained from the various cleaning agents such as enzymes, bleaches and surfactants. Soils are naturally acidic and their presence will tend to lower the intrinsic pH of the wash solution. Resistance to such undesirable pH fluctuations are achieved by the use of buffering agents. The preferred pH range of aqueous solutions of machine dishwashing formulations is 6.5–11 with the particularly preferred range being from 7.0–10.5. The pH delivery and buffering in the system can be provided by various ingredients which can be selected from water-soluble alkali metal (a) carbonates, bicarbonates and/or sesquicarbonates—(b) citrates (c) hydroxides (d) borates (esp. borax) (e) silicates (f) crystalline and amorphous aluminosilicates (g) phytic acid and mixtures or combinations of (a)–(g).

Nonlimiting examples within the class of materials designated silicates include sodium silicate, sodium metasilicate and layered silicates such as those described in U.S. Pat. No. 4,664,839 which are comprised of $SiO_2$:$Na_2O$ ratios in the range of 1.6:1 to 3.2:1. Commercially available layered silicates include NaSKS-5®, NaSKS-6®, NaSKS-7®, and NaSKS-11®, all from Hoechst. Other silicates commerically available include the BRITESIL® H20 AND BRITESIL® H24 from PQ Corp. Silicates are normally incorporated in at levels where they do not negatively impact the spotting and filming performance of the machine dishwashing formulation.

Particularly preferred options are sodium and potassium carbonate, sodium and potassium bicarbonates, sodium citrate, borax, sodium metasilicate and the silicates BRITESIL® H20 and NaSKS-6® as well as binary combinations of sodium citrate and sodium carbonate.

Other ingredients added into the formulation for improved building and sequestration can also serve the role of a primary and/or supplementary buffering agent. These include, in a non limiting list of examples, ethylenediamine tetraacetates, nitrilotriacetates, tartarate monosuccinates, tartarate disuccinates, oxydisuccinates, carboxymethoxysuccinates and sodium benzene polycarboxylate salts.

Other techniques for controlling pH such as pH jump systems, and the use of dual compartments have been previously disclosed and are well known in the art.

In certain cases it may be advantageous to have a controlled change of the pH during the wash cycle and techniques such as the delayed release of acidity as disclosed in U.S. Pat. No. 5,747,438 or the use of enzymatic systems to provide delayed release of alkalinity such as those disclosed in WO 9736984 are known to those skilled in the art. Such practices are not excluded from the present disclosure.

Oxygen Bleaching Systems

The following are preferred oxygen bleach sources:

Peroxy Bleaching Agents—The oxygen bleaching agents of the compositions include organic peroxy acids and diacylperoxides. Typical monoperoxy acids useful herein include alkyl peroxy acids and aryl peroxy acids such as:

i) peroxybenzoic acid and ring-substituted peroxybenzoic acids, e.g., peroxy-alpha-naphthoic acid, and magnesium monoperoxyphthalate ii) aliphatic and substituted aliphatic monoperoxy acids, e.g., peroxylauric acid, peroxystearic acid, epsilon-phthalimido-peroxyhexanoic acid and o-carboxybenzamido peroxyhexanoic acid, N-nonylamidoperadipic acid and N-nonylamidopersuccinic acid.

iii) Cationic peroxyacids such as those described in U.S. Pat. Nos. 5,422,028, 5,294,362; and 5,292,447, are herein incorporated by reference.

iv) Sulfonyl peroxyacids such as compounds described in U.S. Pat. No. 5,039,447 (Monsanto Co.), herein incorporated by reference.

Typical diperoxy acids useful herein include alkyl diperoxy acids and aryl diperoxy acids, such as:

v) 1,12-diperoxydodecanedioic acid vi) 1,9-diperoxyazelaic acid vii) diperoxybrassylic acid; diperoxysecacic acid and diperoxy-isophthalic acid viii) 2-decyldiperoxybutan-1,4-dioic acid ix) $N,N^1$-terephthaloyl-di(6-aminopercaproic acid).

A typical diacylperoxide useful herein includes dibenzoylperoxide.

Inorganic peroxygen compounds are also suitable. Examples of these materials are salts of monopersulfate (available commercially as the trisalt Oxone® from Dupont Chem. Co.), perborate monohydrate, perborate tetrahydrate, percarbonate, pyrophosphate peroxyhydrate, urea peroxyhydrate, and sodium peroxide and mixtures thereof. Sodium perborate monohydrate and sodium percarbonate are particularly preferred.

Preferred peroxy bleaching agents include epsilon-phthalimido-peroxyhexanoic acid, o-carboxybenzamidoperoxyhexanoic acid, and mixtures thereof.

The organic peroxy acid is present in the composition in an amount such that the level of organic peroxy acid in the wash solution is about 1 ppm to about 300 ppm AvOx, preferably about 2 ppm to about 200 ppm AvOx.

The oxygen bleaching agent may be incorporated directly into the formulation or may be encapsulated by any number of encapsulation techniques.

A preferred encapsulation method is described in U.S. Pat. No. 5,200,236 issued to Lang et al., herein incorporated by reference. In the patented method, the bleaching agent is encapsulated as a core in a paraffin wax material having a melting point from about 40° C. to 50° C. The wax coating has a thickness of from 100 to 1500 microns.

Bleach Precursors—Suitable peracid precursors for peroxy bleach compounds have been amply described in the literature, These include, but are not limited to, those referenced in GB Nos. 836,988; 855,735; 907,356; 907,358; 907,950; 1,003,310 and 1,246,339; U.S. Pat. Nos. 3,332,882; 4,128,494; 4,412,934; 4,634,551 and 4,915,854 and WO 96/16155.

Typical examples of precursors are polyacylated alkylene diamines, such as N,N,N',N'-tetraacetylethylene diamine (TAED) and N,N,N',N'-tetraacetylmethylene diamine (TAMD); acylated glycolurils, such as tetraacetylglycoluril (TAGU); xylose tetraacetate, glucose pentaacetate, triacetylcyanurate, sodium sulfophenyl ethyl carbonic acid ester, sodium acetyloxybenene sulfonate (SABS), sodium nonanoyloxy benzene sulfonate (SNOBS) and choline sulfophenyl carbonate. Peroxybenzoic acid precursors are known in the art, e.g., as described in GB-A-836,988. Examples of suitable precursors are phenylbenzoate; phenyl p-nitrobenzoate; o-nitrophenyl benzoate; o-carboxyphenyl benzoate; p-bromophenylbenzoate; sodium or potassium benzoyloxy benzene-sulfonate; and benzoic anhydride.

Another class of bleach activators are the benzoxazin derivatives as have been disclosed in U.S. Pat. No. 4,966,723.

U.S. Pat. No. 4,634,551 discloses a class of precursor compounds which upon perhydrolysis lead to the formation of peracids containing amide groups within their structure. Examples of such precursors include, in a non limiting sense, (6-octanamido-caproyl)oxybenzenesulfonate, (6-nonanamido-caproyl)oxybenzenesulfonate and (6-decanamido-caproyl)oxybenzenesulfonate. Mixtures of such compounds also constitute suitable precusors. Another class of precursor molecules are the acyl lactams such as the acyl valerolactams and the acyl caprolactams. The acyl substituent on these lactam derivatives can be an alkyl, aryl, alkaryl, or alkoxyaryl, containing from about 1 to 12 carbon atoms or substituted phenyl groups containing 6 to 18 carbon atoms. Examples of such acyl groups non limitingly include benzoyl, octanoyl, nonanoyl, decanoyl, undecenoyl, and 3,5,5-trimethylhexanoyl. U.S. Pat. No. 4,545,784 reveals acylcaprolactams adsorbed onto sodium perborate.

Quaternary substituted bleach precursors are also well known in the art. Examples of such compounds have been disclosed in U.S. Pat. Nos. 5,686,015; 5,269,962; 5,106,528; 5,093,022; 4,988,451; 4,904,406; 4,818,426; 4,397,757; 4,283,301 as well as in British Pat. 1,382,594 and in EP 552,812 A1; EP 475,512; EP 458,396 and EP 284,292.

Other types of bleach precursors, some multiply substituted and others with cationic groups have been revealed in U.S. Pat. Nos. 5,560,862; 5,584,888 and 5,460,747.

U.S. Pat. No. 5,753,138 teaches on the use of bleach precursors which are effective at low concentrations of perhydroxide while U.S. Pat. No. 5,739,096 teaches about the use of cyanopyridine N-oxides as bleach activators.

Preferred peroxygen bleach precursors are sodium p-benzoyloxybenzene sulfonate, N,N,N',N'-tetraacetylethylene diamine, sodium nonanoyloxybenzene sulfonate and choline sulfophenyl carbonate.

The peroxygen bleach precursors are preferably present in the composition in an amount from about 1 to about 20 weight percent, preferably from about 1 to about 15 wt. %, most preferably from about 2 to about 15 wt. %. To deliver a functional peroxygen bleach from a precursor, a source of hydrogen peroxide is required. The hydrogen peroxide source is preferably a compound that delivers hydrogen peroxide on dissolution. Preferred sources of hydrogen peroxide are sodium perborate, either as the mono- or tetrahydrate and sodium percarbonate. The source of hydrogen peroxide, when included in these compositions is present at a level of about 1% to about 40% by weight, preferably from about 2% to about 30% by weight, most preferably from about 4% to about 25% by weight.

Bleach Catalyst—An effective amount of a bleach catalyst can also be present in the invention. A number of organic catalysts are available such as the activated imines as described in U.S. Pat. Nos. 5,753,599; 5,693,603; 5,041,232; 5,047,163 and 5,463,115 and those containing quatemary imine salts as described in U.S. Pat. No. 5,550,256 and 5,482,515. Another class of organic bleach catalysts are the dioxiranes as have been disclosed in U.S. Pat. Nos. 5,755,993; 5,525,121 and 3,822,114.

Transition metal bleach catalysts are also useful, especially those based on manganese, iron, cobalt, titanium, molybdenum, nickel, chromium, copper, ruthenium, tungsten and mixtures thereof. These include simple water-soluble salts such as those of iron, manganese and cobalt as well as catalysts containing complex ligands.

The German patent DE1,529,905 teaches on the use of diimine complexes of manganese, iron, cobalt, ruthenium or molybdenum as bleach catalysts.

Suitable examples of manganese catalysts containing organic ligands are described in U.S. Pat. No. 4,728,455, U.S. Pat. No. 5,114,606, U.S. Pat. No. 5,153,161, U.S. Pat. No. 5,194,416, U.S. Pat. No. 5,227,084, U.S. Pat. No. 5,244,594, U.S. Pat. No. 5,246,612, U.S. Pat. No. 5,246,621, U.S. Pat. No. 5,256,779, U.S. Pat. No. 5,274,147, U.S. Pat. No. 5,280,117 and European Pat. App. Pub. Nos. 544,440, 544,490, 549,271 and 549,272. Preferred examples of these catalysts include $Mn^{IV}{}_2(u\text{-}O)_2$(1,4,7-trimethyl-1,4,7-triazacyclononane)$_2(PF_6)_2$, $Mn^{III}{}_2(u\text{-}O)_1(u\text{-}OAc)_2$(1,4,7-trimethyl-1,4,7-triazacyclononane)$_2(ClO_4)_2$, $Mn^{IV}{}_4(u\text{-}O)_1$(1,4,7-triazacyclononane)$_4(ClO_4)_4$, $Mn^{III}Mn^{IV}{}_4(u\text{-}O)_1(u\text{-}OAc)_2$(1,4,7-trimethyl-1,4,7-triazacyclononane)$_2(ClO_4)_3$, $Mn^{IV}$(1,4,7-trimethyl-1,4,7-triazacyclononane)-$(OCH_3)_3(PF_6)$, and mixtures thereof. Other metal-based bleach catalysts include those disclosed in U.S. Pat. No. 4,430,243 and U.S. Pat. No. 5,114,611.

Iron and manganese salts of aminocarboxylic acids in general are useful herein including iron and manganese aminocarboxylate salts disclosed for bleaching in the photographic color processing arts. A particularly useful transition metal salt is derived from ethylenediaminedisuccinate and any complex of this ligand with iron or manganese.

Another type of bleach catalyst, as disclosed in U.S. Pat. No. 5,114,606, is a water soluble complex of manganese (II), (III), and/or (IV) with a ligand which is a non-carboxylate polyhydroxy compound having at least three consecutive C—OH groups. Preferred ligands include sorbitol, iditol, dulsitol, mannitol, xylithol, arabitol, adonitol, meso-erythritol, meso-inositol, lactose and mixtures thereof. Especially preferred is sorbitol.

U.S. Pat. No. 5,114,611 teaches a bleach catalyst comprising a complex of transition metals, including manganese, cobalt, iron or copper with a non-(macro)-cyclic ligand. Other examples include Mn gluconate, $Mn(CF_3SO_3)_2$, and binuclear Mn complexed with tetra-N-dentate and bi-N-dentate ligands, including $[bipy_2Mn^{III}(u\text{-}O)_2Mn^{IV}bipy_2](ClO_4)_3$.

Other bleach catalysts are described, for example, in European Pat. App. Pub. Nos. 408,131 (cobalt complexes), 384,503 and 306,089 (metallo-porphyrins), U.S. Pat. No. 4,728,455 (manganese/multidenate ligand), U.S. Pat. No. 4,711,748 (absorbed manganese on aluminosilicate), U.S. Pat. No. 4,601,845 (aluminosilicate support with manganese, zinc or magnesium salt), U.S. Pat. No. 4,626,373 (manganese/ligand), U.S. Pat. No. 4,119,557 (ferric complex), U.S. Pat. No. 4,430,243 (chelants with manganese cations and non-catalytic metal cations), and U.S. Pat. No. 4,728,455 (manganese gluconates).

Useful catalysts based on cobalt are described in Pat. App. Pub. Nos. WO 96/23859, WO 96/23860 and WO 96/23861 and U.S. Pat. Nos. 5,559,261 and 5,703,030. WO 96/23860 describes cobalt catalysts of the type $[Co_nL_mX_p]^zY_z$, where L is an organic ligand molecule containing more than one heteroatom selected from N, P, O and S; X is a coordinating species; n is preferably 1 or 2; m is preferably 1 to 5; p is preferably 0 to 4 and Y is a counterion. One example of such a catalyst is N,N'-Bis(salicylidene)ethylenediaminecobalt (II). Other cobalt catalysts described in these applications are based on Co(III) complexes with ammonia and mon-, bi-, tri- and tetradentate ligands such as $[Co(NH_3)_5OAc]^{2+}$ with $Cl^-$, $OAc^-$, $PF_6^-$, $SO_4^=$, and $BF_4^-$ anions.

Certain transition-metal containing bleach catalysts can be prepared in situ by the reaction of a transition-metal salt with a suitable chelating agent, for example, a mixture of manganese sulfate and ethylenediaminedisuccinate. Highly colored transition metal-containing bleach catalysts may be co-processed with zeolites to reduce the color impact.

When present, the bleach catalyst is typically incorporated at a level of about 0.0001 to about 10% by wt., preferably about 0.001 to about 5% by weight.

Surfactants

Optionally, a surfactant selected from the list including anionic, nonionic, cationic, amphoteric, and zwifteronic surfactants and mixtures of these surface active agents may be included in the machine dishwashing formulation. Such surfactants are well known in the detergent arts and are described at length in "Surface Active Agents and Detergents", Vol. 2 by Schwartz, Perry and Birch, Interscience Publishers, Inc., 1959, herein incorporated by reference.

Preferred surfactants are one or a mixture of:

Anionic surfactants—Anionic synthetic detergents can be broadly described as surface active compounds with one or more negatively charged functional groups. An important class of anionic compounds are the water-soluble salts, particularly the alkali metal salts, of organic sulfur reaction products having in their molecular structure an alkyl radical containing from about 6 to 24 carbon atoms and a radical selected from the group consisting of sulfonic and sulfuric acid ester radicals.

Primary Alkyl Sulfates $$R^7OSO_3M$$

where $R^7$ is a primary alkyl group of 8 to 18 carbon atoms and M is a solubilizing cation. The alkyl group $R^7$ may have a mixture of chain lengths. It is preferred that at least two-thirds of the $R^7$ alkyl groups have a chain length of 8 to 14 carbon atoms. This will be the case if $R^7$ is coconut alkyl, for example. The solubilizing cation may be a range of cations which are in general monovalent and confer water solubility. An alkali metal, notably sodium, is especially envisaged. Other possibilities are ammonium and substituted ammonium ions, such as trialkanolammonium or trialkylammonium.

Alkyl Ether Sulfates $$R^7O(CH_2CH_2O)_nSO_3M$$

where $R^7$ is a primary alkyl group of 8 to 18 carbon atoms, n has an average value in the range from 1 to 6 and M is a solubilizing cation. The alkyl group $R^7$ may have a mixture of chain lengths. It is preferred that at least two-thirds of the $R^7$ alkyl groups have a chain length of 8 to 14 carbon atoms. This will be the case if $R^7$ is coconut alkyl, for example. Preferably n has an average value of 2 to 5.

Fatty Acid Ester Sulfonates $$R^8CH(SO_3M)CO_2R^9$$

where $R^8$ is an alkyl group of 6 to 16 atoms, $R^9$ is an alkyl group of 1 to 4 carbon atoms and M is a solubilizing cation. The group $R^8$ may have a mixture of chain lengths. Preferably at least two-thirds of these groups have 6 to 12 carbon atoms. This will be the case when the moiety $R^8CH(-)CO_2(-)$ is derived from a coconut source, for instance. It is preferred that $R^9$ is a straight chain alkyl, notably methyl or ethyl.

Alkyl Benzene Sulfonates $$R^{10}ArSO_3M$$

where $R^{10}$ is an alkyl group of 8 to 18 carbon atoms, Ar is a benzene ring ($C_6H_4$) and M is a solubilizing cation. The group $R^{10}$ may be a mixture of chain lengths. Straight chains of 11 to 14 carbon atoms are preferred.

Paraffin sulfonates having 8 to 22 carbon atoms, preferably 12 to 16 carbon atoms, in the alkyl moiety. These surfactants are commercially available as Hostapur SAS from Hoechst Celanese. Olefin sulfonates having 8 to 22 carbon atoms, preferably 12 to 16 carbon atoms. U.S. Pat. No. 3,332,880 contains a description of suitable olefin sulfonates.

Organic phosphate based anionic surfactants include organic phosphate esters such as complex mono- or diester phosphates of hydroxyl-terminated alkoxide condensates, or salts thereof. Included in the organic phosphate esters are phosphate ester derivatives of polyoxyalkylated alkylaryl phosphate esters, of ethoxylated linear alcohols and ethoxylates of phenol. Also included are nonionic alkoxylates having a sodium alkylenecarboxylate moiety linked to a terminal hydroxyl group of the nonionic through an ether bond. Counterions to the salts of all the foregoing may be those of alkali metal, alkaline earth metal, ammonium, alkanolammonium and alkylammonium types.

Particularly preferred anionic surfactants are the fatty acid ester sulfonates with formula:

$$R^8CH(SO_3M)CO_2R^9$$

where the moiety $R^8CH(-)CO_2(-)$ is derived from a coconut source and $R^9$ is either methyl or ethyl; primary alkyl sulfates with the formula:

$$R^7OSO_3M$$

wherein $R^7$ is a primary alkyl group of 10 to 18 carbon atoms and M is a sodium cation; and paraffin sulfonates, preferably with 12 to 16 carbon atoms to the alkyl moiety.

Nonionic surfactants—Nonionic surfactants can be broadly defined as surface active compounds with one or more uncharged hydrophilic substituents. A major class of nonionic surfactants are those compounds produced by the condensation of alkylene oxide groups with an organic hydrophobic material which may be aliphatic or alkyl aromatic in nature. The length of the hydrophilic or polyoxyalkylene radical which is condensed with any particular hydrophobic group can be readily adjusted to yield a water-soluble compound having the desired degree of balance between hydrophilic and hydrophobic elements. Illustrative, but not limiting examples, of various suitable nonionic surfactant types are:

polyoxyalkene condensates of aliphatic carboxylic acids, whether linear- or branched-chain and unsaturated or saturated, especially ethoxylated and/or propoxylated aliphatic acids containing from about 8 to about 18 carbon atoms in the aliphatic chain and incorporating from about 2 to about 50 ethylene oxide and/or propylene oxide units. Suitable carboxylic acids include "coconut" fatty acids (derived from coconut oil) which contain an average of about 12 carbon atoms, "tallow" fatty acids (derived from tallow-class fats) which contain an average of about 18 carbon atoms, palmitic acid, myristic acid, stearic acid and lauric acid.

polyoxyalkene condensates of aliphatic alcohols, whether linear- or branched-chain and unsaturated or saturated, especially ethoxylated and/or propoxylated aliphatic alcohols containing from about 6 to about 24 carbon atoms and incorporating from about 2 to about 50 ethylene oxide and/or propylene oxide units. Suitable alcohols include "coconut" fatty alcohol, "tallow" fatty alcohol, lauryl alcohol, myristyl alcohol and oleyl alcohol.

Ethoxylated fatty alcohols may be used alone or in admixture with anionic surfactants, especially the preferred surfactants above. The average chain lengths of the alkyl group $R^{11}$ in the general formula:

$$R^{11}O(CH_2CH_2O)_nH$$

is from 6 to 20 carbon atoms. Notably the group $R^{11}$ may have chain lengths in a range from 9 to 18 carbon atoms.

The average value of n should be at least 2. The numbers of ethylene oxide residues may be a statistical distribution around the average value. However, as is known, the distribution can be affected by the manufacturing process or altered by fractionation after ethoxylation. Particularly preferred ethoxylated fatty alcohols have a group $R^{11}$which has 9 to 18 carbon atoms while n is from 2 to 8.

Also included within this category are nonionic surfactants having a formula:

$$R^{12}\text{—}(CH_2\underset{\underset{R^{13}}{|}}{C}HO)_x(CH_2CH_2O)_y(CH_2\underset{\underset{R^{14}}{|}}{C}HO)_zH$$

wherein $R^{12}$ is a linear alkyl hydrocarbon radical having an average of 6 to 18 carbon atoms, $R^{13}$ and $R^{14}$ are each linear alkyl hydrocarbons of about 1 to about 4 carbon atoms, x is an integer of from 1 to 6, y is an integer of from 4 to 20 and z is an integer from 4 to 25.

One preferred nonionic surfactant of the above formula is Poly-Tergent SLF-18 a registered trademark of the Olin Corporation, New Haven, Conn. having a composition of the above formula where $R^{12}$ is a $C_6$–$C_{10}$ linear alkyl mixture, $R^{13}$ and $R^{14}$ are methyl, x averages 3, y averages 12 and z averages 16. Another preferred nonionic surfactant is:

$$R^{15}—O—(CH_2\underset{\underset{CH_3}{|}}{C}HO)_j(CH_2CH_2O)_k(CH_2(OH)R^{16})_l$$

wherein $R^{15}$ is a linear, aliphatic hydrocarbon radical having from about 4 to about 18 carbon atoms including mixtures thereof; and $R^{16}$ is a linear, aliphatic hydrocarbon radical having from about 2 to about 26 carbon atoms including mixtures thereof; j is an integer having a value of from 1 to about 3; k is an integer having a value from 5 to about 30; and l is an integer having a value of from 1 to about 3. Most preferred are compositions in which j is 1, k is from about 10 to about 20 and l is 1. These surfactants are described in WO 94/22800. Other preferred nonionic surfactants are linear fatty alcohol alkoxylates with a capped terminal group, as described in U.S. Pat. No. 4,340,766 to BASF. Particularly preferred is Plurafac LF403 ex. BASF.

Another nonionic surfactant included within this category are compounds of formula:

$$R^{17}—(CH_2CH_2O)_qH$$

wherein $R^{17}$ is a $C_6$–$C_{24}$ linear or branched alkyl hydrocarbon radical and q is a number from 2 to 50; more preferably $R^{17}$ is a $C_8$–$C_{18}$. linear alkyl mixture and q is a number from 2 to 15.

polyoxyethylene or polyoxypropylene condensates of alkyl phenols, whether linear- or branched-chain and unsaturated or saturated, containing from about 6 to 12 carbon atoms and incorporating from about 2 to about 25 moles of ethylene oxide and/or propylene oxide.

polyoxyethylene denvadives of sorbitan mono-, di-, and tri-fatty acid esters wherein the fatty acid component has between about 12 and about 24 carbon atoms. The preferred polyoxyethylene derivatives are of sorbitan monolaurate, sorbitan trilaurate, sorbitan monopalmitate, $sorbitan tripalmitate, sorbitan monostearate, sorbitan monoisostearate, sorbital tristearate, sorbitan monooleate, and sorbitan trioleate. The polyoxyethylene chains may contain between about 4 and about 30 ethylene oxide units, preferably about 10 to about 20. The sorbitan ester derivatives contain 1, 2 or 3 polyoxyethylene chains dependent upon whether they are mono-, di- or tn-acid esters.

polyoxyethylene-polyoxypropylene block copolymers having formula:

$$HO(CH_2CH_2O)_a(CH(CH_3)CH_2O)_b(CH_2CH_2O)_cH$$

or $$HO(CH(CH_3)CH_2O)_d(CH_2CH_2O)_e(CH(CH_3)CH_2O)_fH$$

wherein a, b, c, d, e and f are integers from 1 to 350 reflecting the respective polyethylene oxide and polypropylene oxide blocks of said polymer. The polyoxyethylene component of the block polymer constitutes at least about 10% of the block polymer. The material preferably has a molecular weight of between about 1,000 and about 15,000, more preferably from about 1,500 to about 6,000. These materials are well-known in the art. They are available under the trademark "Pluronic" and "Pluronic R", a product of BASF Corporation.

Alkyl Glycosides $$R^{21}O(R^{22}O)_n(Z^1)_p$$

wherein $R^{21}$ is a monovalent organic radical (e.g., a monovalent saturated aliphatic, unsaturated aliphatic or aromatic radical such as alkyl, hydroxyalkyl, alkenyl, hydroxyalkenyl, aryl, alkylaryl, hydroxyalkylaryl, arylalkyl, alkenylaryl, arylalkenyl, etc.) containing from about 6 to about 30 (preferably from about 8 to 18 and more preferably from about 9 to about 13) carbon atoms; $R^{22}$ is a divalent hydrocarbon radical containing from 2 to about 4 carbon atoms such as ethylene, propylene or butylene (most preferably the unit $(R^{22}O)_n$ represents repeating units of ethylene oxide, propylene oxide and/or random or block combinations thereof); n is a number having an average value of from 0 to about 12; $Z^1$ represents a moiety derived from a reducing saccharide containing 5 or 6 carbon atoms (most preferably a glucose unit); and p is a number having an average value of from 0.5 to about 10 preferably from about 0.5 to about 5.

Examples of commercially available materials from Henkel Kommanditgesellschaft Aktien of Dusseldorf, Germany include APG 300, 325 and 350 with $R^{21}$ being $C_9$–$C_{11}$, n is 0 and p is 1.3, 1.6 and 1.8–2.2 respectively; APG 500 and 550 with $R^{21}$ is $C_{12}$–$C_{13}$, n is 0 and p is 1.3 and 1.8–2.2, respectively; and APG 600 with $R^{21}$ being $C_{12}$–$C_{14}$, n is 0 and p is 1.3.

While esters of glucose are contemplated especially, it is envisaged that corresponding materials based on other reducing sugars, such as galactose and mannose are also suitable.

Amine oxides having formula:

$$R^{18}R^{19}R^{20}N{=}O$$

wherein $R^{18}$, $R^{19}$ and $R^{20}$ are saturated aliphatic radicals or substituted saturated aliphatic radicals. Preferable amine oxides are those wherein $R^{18}$ is an alkyl chain of about 10 to about 20 carbon atoms and $R^{19}$ and $R^{20}$ are methyl or ethyl groups or both $R^{18}$ and $R^{19}$ are alkyl chains of about 6 to about 14 carbon atoms and $R^{20}$ is a methyl or ethyl group.

Amphoteric synthetic detergents—can be broadly described as derivatives of aliphatic tertiary amines, in which the aliphatic radical may be straight chain or branched and wherein one of the aliphatic substituents contain from about 8 to about 18 carbons and one contains an anionic water-solubilizing group, i.e., carboxy, sulpho, sulphato, phosphato or phosphono. Examples of compounds falling within this definition are sodium 3-dodecylamino propionate and sodium 2-dodecylamino propane sulfonate.

Zwitterionic synthetic detergents—can be broadly described as derivatives of aliphatic quaternary ammonium, phosphonium and sulphonium compounds in which the aliphatic radical may be straight chained or branched, and wherein one of the aliphatic substituents contains from about 8 to about 18 carbon atoms and one contains an anionic water-solubilizing group, e.g., carboxy, sulpho, sulphato, phosphato or phosphono. These compounds are frequently referred to as betaines. Besides alkyl betaines, alkyl amino. and alkyl amido betaines are encompassed within this invention.

Particularly preferred nonionic surfactants are polyoxyethylene and polyoxypropylene condensates of linear aliphatic alcohols.

The preferred range of surfactant is from about 0.5 to about 30% by wt., more preferably from about 0.5 to about 15% by weight of the composition.

Sequestrants

The detergent compositions herein may also optionally contain one or more transition metal chelating agents. These components may also have calcium and magnesium chelation capacity, but preferentially they show selectivity to binding heavy metal ions. Such chelating agents can be selected from the group consisting of amino carboxylates, amino phosphonates, polyfunctionally-substituted aromatic chelating agents and mixtures therein. Without intending to be bound by theory, it is believed that the benefit of these materials is due in part to their exceptional ability to remove iron and manganese ions from washing solutions by formation of soluble chelates.

Amino carboxylates useful as optional chelating agents include ethylenediaminetetraacetates, N-hydroxyethylethylenediaminetriacetates, nitrilotriacetates, ethylenediamine tetraproprionates, triethylenetetraamine-hexaacetates, diethylenetriaminepentaacetates, ethylenediamine disuccinate, and ethanoldiglycines, alkali metal, ammonium, and substituted ammonium salts therein and mixtures therein.

Amino phosphonates are also suitable for use as chelating agents in the compositions of the invention when at least low levels of total phosphorus are permitted in detergent compositions, and include ethylenediaminetetrakis (methylenephosphonates) and diethylenetriaminepentakis (methylenephosphonates). Preferably, these amino phosphonates do not contain alkyl or alkenyl groups with more than about 6 carbon atoms.

Polyfunctionally-substituted aromatic chelating agents are also useful in the compositions herein. See U.S. Pat. No. 3,812,044, issued May 21, 1974, to Connor et al. Preferred compounds of this type in acid form are dihydroxydisulfobenzenes such as 1,2-dihydroxy-3,5-disulfobenzene.

If utilized, these chelating agents will generally comprise from about 0.1% to about 10% by weight of the detergent compositions herein. More preferably, if utilized, the chelating agents will comprise from about 0.1% to about 5.0% by weight of such composition.

Anti-Scalants

Scale formation on dishes and machine parts can be a significant problem. It can arise from a number of sources but, primarily it results from precipitation of either alkaline earth metal carbonates, phosphates or silicates. Calcium carbonate and phosphates are the most significant problem. To reduce this problem, ingredients to minimize scale formation can be incorporated into the composition. These include polyacrylates of molecular weight from 1,000 to 400,000 examples of which are supplied by Rohm & Haas, BASF and Alco Corp. and polymers based on acrylic acid combined with other moieties. These include acrylic acid combined with maleic acid, such as Sokalan CP5 and CP7 supplied by BASF or Acusol 479N supplied by Rohm & Haas; with methacrylic acid such as Colloid 226/35 supplied by Rhone-Poulenc; with phosphonate such as Casi 773 supplied by Buckman Laboratories; with maleic acid and vinyl acetate such as polymers supplied by Hüls; with acrylamide; with sulfophenol methallyl ether such as Aquatreat AR 540 supplied by Alco; with 2-acrylamido-2-methylpropane sulfonic acid such as Acumer 3100 supplied by Rohm & Haas or such as K-775 supplied by Goodrich; with 2-acrylamido-2-methylpropane sulfonic acid and sodium styrene sulfonate such as K-798 supplied by Goodrich; with methyl methacrylate, sodium methallyl sulfonate and sulfophenol methallyl ether such as Alcoperse 240 supplied by Alco; polymaleates such as Belclene 200 supplied by FMC; polymethacrylates such as Tamol 850 from Rohm & Haas; polyaspartates; ethylenediamine disuccinate; organo polyphosphonic acids and their salts such as the sodium salts of aminotri(methylenephosphonic acid) and ethane 1-hydroxy-1,1-diphosphonic acid. The anti-scalant, if present, is included in the composition from about 0.05% to about 10% by weight, preferably from 0.1% t o about 5% by weight, most preferably from about 0.2% to about 5% by weight.

Corrosion Inhibitors

The composition my optionally contain corrosion inhibitors to reduce the tarnishing of silver flatware. Such inhibitors include benzotriazole and other members of the azole family. Particularly preferred are azoles, including imidazoles. Additional antitarnish additives include water-soluble bismuth compounds such as bismuth nitrate as taught in GB 2,297,096 A; heavy metal salts of copper, iron, manganese, zinc, or titanium (EP 0 636 688 A1, GB 2,283,494 A); paraffin oil; and non-paraffin oil organic agents such as fatty esters of mono or polyhydridic alcohols as claimed in EP 0 690 122 A2.

Antifoams

The compositions, when formulated for use in machine dishwashing compositions, preferably include an antifoam system. Suitable antifoam systems for use herein may include essentially any known antifoam compound, including, for example, silicone antifoams, silicone oil, mono- and distearyl acid phosphates, mineral oil, and 2-alkyl and alcanol antifoam compounds. Even if the machine dishwashing composition contains only defoaming surfactants, the antifoam assists to minimize foam which food soils can generate. The compositions may include 0.02 to 2% by weight of antifoam, preferably, 0.05 to 1.0%.

Form of the Composition

The machine dishwashing compositions disclosed herein can be formulated in any desirable form such as powders, granulates, pastes, liquids, gels, solids or tablets. As an example, the process of preparing a granulate may involve preparing a slurry of the ingredients identified above and drying the mixture by means of suitable equipment such as a turbine dryer (Turbogranulation dryer ex Vomm-Turbo Technology, Vomm Impianti E Processi SrL, Milan, Italy). Also, the process may involve preparing the slurry, spray-drying the slurry by conventional techniques using a spray tower in which the slurry is atomized and dried in a hot air stream, followed by restructuring the resulting powder, optionally after milling, in a granulation process (Lödige recycler and Lodige plow shear). In a particularly preferred process, the slurry is sprayed onto fine (recycled) particles and then dried to form gradually growing co-granules. Another attractive possibility is to dry the slurry in a rotary drum granulator and to spray slurry onto recirculated fines, thus building up coarser particles. These particles are either simultaneously or subsequently dried to give a co-granule with a more homogeneous moisture distribution than those obtained by use of a turbine dryer.

The process of preparing a tablet may involve admixing the ingredients identified above, transferring the mixture to the tablet die, and compressing with a compaction pressure from about of $3\times10^6$ kg/m$^2$ to about $3\times10^7$ kg/m$^2$. It may be preferable to pre-granulate some or all of the ingredients, optionally with surfactant to enhance dissolution, to give granulates of size 100–2000 microns and mix these together with any remaining material prior to compaction. Another possibility is to pre-coat the granulate with any liquid component of the composition via, for example, a fluid bed, pan coater or rolling drum to give encapsulates. The encapsulates are then compressed with a compaction pressure from about $1\times10^6$ kg/m$^2$ to about $3\times10^7$ kg/m$^2$.

Machine Dishwashing Method

A preferred machine dishwashing method includes treating soiled articles selected from crockery, glassware, hollowware, silverware and cutlery and mixtures thereof, with an aqueous solution having dissolved or dispersed therein an effective amount of a machine dishwashing composition disclosed herein. By an effective amount of the machine dishwashing composition it is meant from 8 g to 60 g of the composition dissolved or dispersed in a wash solution of volume from 3 to 10 liters, as typical product dosages and wash solution volumes commonly employed in conventional machine dishwashing methods.

In the following examples, all parts, percentages and portions referred to are by weight.

EXAMPLES 1–4

Preferred machine dishwashing detergent formulations were prepared as detailed below. All figures given refer to parts by weight percent. Examples 1 and 3 are granular products based on a phosphate builder while Example 4 is a granular product based on a non-phosphate builder. Example 2 is a simplified version of Example 1 in which the cationic surfactant is also left out.

| Component | Ex. 1 | Ex. 2 | Ex. 3 | Ex. 4 |
|---|---|---|---|---|
| Sodium tripolyphosphate | 51.3 | 63.3 | 15–70 | — |
| Tri-sodium citrate dihydrate | — | — | — | 10–60 |
| Acrylate/maleate copolymer[1] | — | — | — | 0–5 |
| Amorphous sodium silicate ($SiO_2$:$Na_2O$ = 2) | 7.2 | 8.9 | 0–20 | 0–20 |
| Sodium carbonate | 10.2 | 12.6 | 0–30 | 0–30 |
| Sodium perborate monohydrate | 10.3 | 12.7 | 0–20 | 0–20 |
| Tetraacetyl ethylene diamine - 83% | 2.0 | 2.5 | 0–5 | 0–5 |
| Nonionic[2] | 0.8O | — | 0–5 | 0–5 |
| Enzymes | 2.0 | — | 0–5 | 0–5 |
| Sodium sulfate | 13.6 | — | 0–50 | 0–50 |
| Cationic surfactant[3] | 2.5 | — | 1–5 | 1–5 |

[1]Sokalan CP7 [40% solids] ex BASF
[2]LF 403 ex BASF
[3]Described in Examples 6–13

EXAMPLES 5–13

The effect on plastic article appearance of a machine dishwashing composition according to Example 1 of the present invention was determined by conducting a wash-cycle procedure after which the wash articles were evaluated for spotting and filming. The results are recorded in Table 1.

In this appearance test, 10 clean glasses were placed on the upper rack of an Electrolux ESF 675 automatic dishwasher and 40.0 g ASTM buttermilk soil, consisting of 82.5% margarine and 17.5% of low fat powdered milk, was spread on the dishwasher door. Along with the ASTM soil, 5 egg yolk soiled plates and 5 starch soiled plates were placed on the bottom rack of the dishwasher. Clean plastic Rubbermaid® containers were placed on the lower rack of the dishwasher as well. A Normal wash program consisted of a cold prewash, 65° C. main wash followed by two cold rinses, and a heated (to 65° C.) final rinse with a non-heated dry cycle. Water was adjusted to 500 ppm hardness (expressed as $CaCO_3$) with a Ca:Mg ratio of 4:1. In the test, 32.8 g of the formulation of Example 1 was dosed via the dispenser cup of the automatic dishwasher. Example 5, a "hole" was left in place of the water soluble cationic surfactant while, for Examples 6–13, water soluble cationic surfactant was included at 2.5% of the formulation as indicated in Example 1. After completion of the wash program, the appearance of the washed plasticware was examined visually to assess spotting and filming. Washed containers were scored using a 0–5 scale in which 0 is clean and 5 is completely covered with spots or heavy chalky film, respectively. Results are recorded in Table I.

The effect of the machine dishwashing composition of Example 2 on plastic damage was studied by a test in which 6.56 g of this composition was dissolved in a jacketed beaker containing 1.0 liter of soft water heated to 65 ° C. In Examples 14–21, the respective cationic surfactant was added to the wash liquor in an amount sufficient to prepare a 1.0% solution. 5 cm×5 cm polycarbonate coupons were immersed into the surfactant solution. After 120 hr. of continuous treatment at 65° C., the coupons were rinsed, air dried and visually assessed for potential surface damage according to the following 1–4 scale:

1=identical to the unwashed coupon
2=bluing or iridescence in patches but majority of coupon is still transparent and shiny
3=loss of shine but surface is still smooth, coupon is translucent
4=complete loss of shine, surface is rough, coupon is opaque Results of this test are summarized in Table II.

TABLE I

| Example | Cationic surfactant | Abbreviated structure | spot/film |
|---|---|---|---|
| 5 | control | — | 2.5/1.5 |
| 6 | CTAB | $C_{16}N(CH_3)_3Br$ | 0.0/0.0 |
| 7 | CTAC | $C_{16}N(CH_3)_3Cl$ | 0.5/0.5 |
| 8 | MTAB | $C_{14}N(CH_3)_3Br$ | 1.0/1.0 |
| 9 | Variquat 638 | Coco $N(CH_3)(EO)_2Cl$ | 0.5/0.0 |
| 10 | DPSC-287 | Tallow $N(CH_3)(EO_y)(EO_{5-y})Br^*$ | 4.0/3.5 |
| 11 | Rewoquat CPEM | Coco $N(CH_3)(EO_y)(EO_{5-y})Br^*$ | 4.0/4.0 |
| 12 | Variquat 66 | Tallow $N(CH_2CH_3)(EO_x)(EO_{15-x})MeSO_4^{\#}$ | 0.0/0.0 |
| 13 | Variquat K1215 | Coco $N(CH_3)(EO_x)(EO_{15-x})Cl^{\#}$ | 0.0/0.0 |

*integer y < 5
#integer x < 15

TABLE II

| Example | Cationic surfactant | Abbreviated structure | plastic damage |
|---|---|---|---|
| 14 | control | — | 1 |
| 15 | CTAB | $C_{16}N(CH_3)_3Br$ | 4 |
| 16 | CTAC | $C_{16}N(CH_3)_3Cl$ | 4 |
| 17 | MTAB | $C_{14}N(CH_3)_3Br$ | 4 |
| 18 | Variquat 638 | Coco $N(CH_3)(EO)_2Cl$ | 4 |
| 19 | DPSC-287 | Tallow $N(CH_3)(EO_y)(EO_{5-y})Br^*$ | 3.5 |
| 20 | Rewoquat CPEM | Coco $N(CH_3)(EO_y)(EO_{5-y})Br^*$ | 3 |
| 21 | Variquat 66 | Tallow $N(CH_2CH_3)(EO_x)(EO_{15-x})MeSO_4^{\#}$ | 2.5 |
| 22 | Variquat K1215 | Coco $N(CH_3)(EO_x)(EO_{15-x})Cl^{\#}$ | 2 |

*integer y < 5
#integer x < 15

As shown by the above examples, water soluble cationic surfactants, whose structures can be represented as in example formula I (surfactant formula, set forth above) and in which each of $R_2$, $R_3$, and $R_4$ represent methyl radicals (Examples 6–8), significantly reduce spotting and filming on plastic articles relative to the control (Example 5). However, significant damage to the polycarbonate coupons is realized (Examples 15–17). Similarly, water soluble cabonic surfactants whose structures can be represented as in surfactant formula I and in which both of $R_3$ and $R_4$ are 2-hydroxyethyl groups (Examples 9 and 18, m and n are each unity in surfactant formulas II and III) give rise to a similar compromise in plastic durability. Examples 10, 11, 19 and 20 which are representative of preferred embodiments, give a reduced level of damage on polycarbonate coupons but compromise on the spotting and filming benefit. Examples 12, 13, 21 and 22 which are representative of the particularly preferred embodiment, keep damage to plastic articles at a low level while delivering excellent plastic ware appearance, with spot and film scores significantly reduced relative to the control.

What is claimed is:

1. A method for washing a soiled plastic article in a machine dishwasher comprising the steps of:

a) contacting the soiled plastic article with a dishwashing detergent composition in tablet form comprising from about 0.1 to about 20% by weight of a cationic surfactant having the formula:;

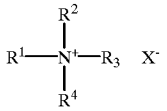

wherein $R^1$ is a group comprising from about 6 to about 20 carbon atoms; $R^2$ is a group comprising from about 1 to about 10 carbon atoms; $R^3$ and $R^4$ are each a polyoxyalkene condensate comprising from about 1 to about 25 oxyalkene units; $X^-$ is an anion selected from the group consisting of chloride, iodide, bromide, methyl sulfate, ethyl sulfate, and sulfate; from about 0.1% to about 90% by weight of a water soluble phosphate; from about 1% to about 40% by weight of a peroxygen bleach; up to about 10% by weight of an active enzyme; and a buffering system in an effective amount to deliver a pH of about 6 to about 11 in the wash water;

b) cleaning the soiled plastic article with the dishwashing detergent composition to produce an unsoiled plastic article; and c) removing the unsoiled plastic article from the dishwashing detergent.

2. A method for washing a soiled plastic article according to claim 1 wherein the cationic surfactant is water soluble.

* * * * *